US006171161B1

(12) United States Patent
Peterson

(10) Patent No.: US 6,171,161 B1
(45) Date of Patent: Jan. 9, 2001

(54) INFLATABLE WATER CRAFT

(75) Inventor: Leroy L. Peterson, Omaha, NE (US)

(73) Assignee: Sportsstuff Inc., Omaha, NE (US)

( * ) Notice: Under 35 U.S.C. 154(b), the term of this patent shall be extended for 0 days.

(21) Appl. No.: 09/574,195

(22) Filed: May 18, 2000

(51) Int. Cl.[7] ..... B63C 9/08

(52) U.S. Cl. ..... 441/130; 114/345; 441/66

(58) Field of Search ..... 441/35, 40–42, 441/66, 129–132; 114/345; 472/128, 129

(56) References Cited

U.S. PATENT DOCUMENTS 2,999,253 * 9/1961 Lewis ..... 114/347

* cited by examiner

*Primary Examiner*—Ed Swinehart
(74) *Attorney, Agent, or Firm*—Henderson & Sturm LLP

(57) ABSTRACT

An inflatable water craft including an inboard storage compartment. The storage compartment extends between the top and bottom surfaces of the body of the water craft and includes inflatable sidewalls and an inflatable cover that provide an insulated compartment for carrying items such as beverages and food.

12 Claims, 1 Drawing Sheet

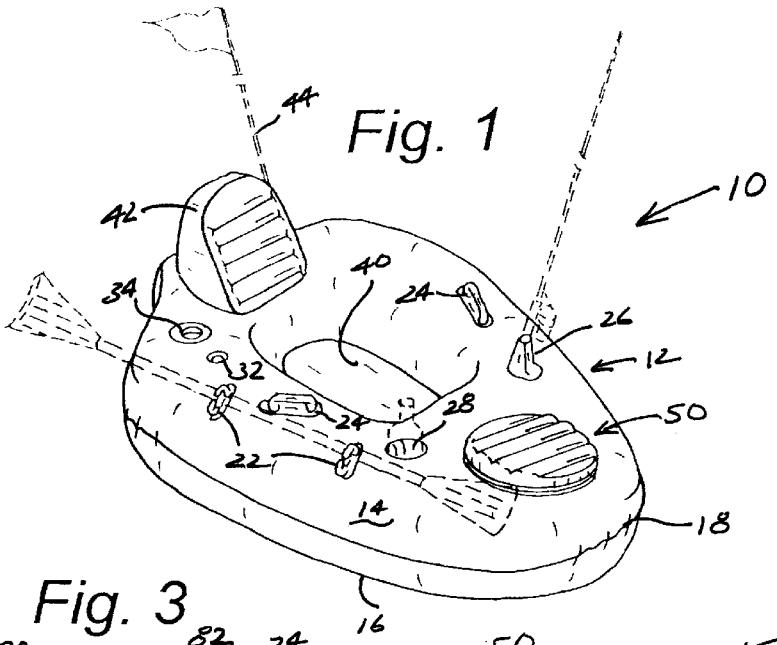
Fig. 1
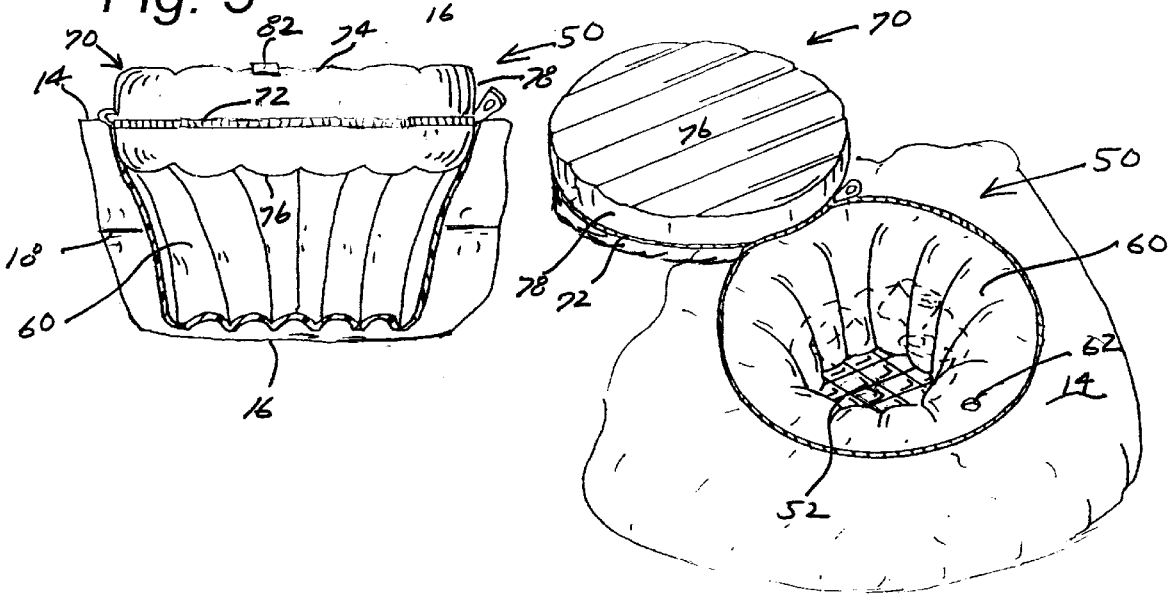
Fig. 3
Fig. 2

INFLATABLE WATER CRAFT

BACKGROUND OF THE INVENTION

1. Field of the Invention

The present invention relates to the field of recreational vehicles, and more particularly to an inflatable water craft having an inboard storage compartment.

2. Description of Related Art

The prior art is replete with myriad and diverse inflatable water craft. While all of the aforementioned prior art constructions are more than adequate for the basic purpose and function for which they have been specifically designed, they are uniformly deficient with respect to their failure to provide a simple, efficient, and practical inflatable water craft with an inboard storage compartment.

As a consequence of the foregoing situation, there has existed a longstanding need for a new and improved inflatable water craft, and the provision of such a construction is a stated objective of the present invention.

BRIEF SUMMARY OF THE INVENTION

Briefly stated, the invention provides an inflatable water craft including an inboard storage compartment. The storage compartment extends between the top and bottom surfaces of the body of the water craft and includes inflatable sidewalls and an inflatable cover that provide an insulated compartment for carrying items such as beverages and food.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the inflatable water craft of the present invention;

FIG. 2 is a partial perspective view showing the storage compartment with inflatable sidewalls and cover; and FIG. 3 is a side elevational view with portions cut away to show the interior of the compartment when the cover is in the closed position.

DETAILED DESCRIPTION OF THE INVENTION

As can be seen by reference to the drawings, and in particular to FIG. 1, the inflatable water craft that forms the basis of the present invention is designated generally by the reference number 10. The water craft 10 includes a body member 12 having a top surface 14, a bottom surface 16, and an outer peripheral edge 18. The top surface 14 carries oar clips 22, handles 24, a rod holder 26, a can holder 28, a mooring loop 32, and an air inflation valve 34. A passenger cockpit 40 is disposed centrally of the body member 12, a backrest 42 is disposed behind the cockpit 40, and a safety flag 44 is carried on the side of the backrest 40.

A storage compartment 50 is disposed inboard of the peripheral edge 18 between the front of the body member 12 and the cockpit 40. The compartment extends between the bottom surface 16 and the top surface 14 of the body member 12. The compartment 50 includes a bottom 52 positioned at the bottom surface 16 of the body member 12. Inflatable sidewalls 60 extend up from the compartment bottom 52 to the top surface 14 of the body member 12. The sidewalls 60 carry a sidewall inflation valve 62 through which the sidewalls 60 may be inflated separately from the body member 12.

An inflatable cover 70 is attached by a zipper closure 72 to the top surface 14 of the body member 12. The cover 70 is selectively moved between an open position (FIG. 2) and a closed position (FIG. 3). The cover 70 includes a top 74, a bottom 76, and an outer edge 78. The zipper 72 is positioned between the top 74 and bottom 76 so that a portion of the cover 70 extends below the top surface 14 of the body member 12 when the cover 70 is in the closed position (FIG. 3). The top 74 carries a cover inflation valve 82 through which the cover 70 may be separately inflated from the body member 12.

The storage compartment 50 is conveniently positioned to be accessible to the passenger. The air inflated sidewalls 60 and cover 70 also provide an insulated compartment 50 for storage of items such as beverages and food.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An inflatable water craft comprising:

an inflatable body member including a top surface, a bottom surface, and an outer peripheral edge;

a storage compartment disposed inboard of the peripheral edge, and extending between the bottom surface and the top surface of the body member, the compartment including a bottom positioned at the bottom surface of the body member, inflatable sidewalls extending up from the compartment bottom to the top surface of the body member, and an inflatable cover selectively attached to the top surface of the body member and being movable between a closed position and an open position.

2. The inflatable water craft of claim 1 wherein the inflatable cover is attached by a zipper closure.

3. The inflatable water craft of claim 2 wherein the cover includes a top, a bottom, and an outer edge extending between the top and bottom, and wherein a portion of the zipper closure is positioned on the outer edge intermediate the top and the bottom.

4. The inflatable water craft of claim 1 wherein the compartment sidewalls carry a sidewall inflation valve through which the compartment sidewalls are inflated separately from the body member.

5. The inflatable water craft of claim 2 wherein the compartment sidewalls carry a sidewall inflation valve through which the compartment sidewalls are inflated separately from the body member.

6. The inflatable water craft of claim 3 wherein the compartment sidewalls carry a sidewall inflation valve through which the compartment sidewalls are inflated separately from the body member.

7. The inflatable water craft of claim 1 wherein the cover carries a cover inflation valve through which the cover is inflated separately from the body member.

8. The inflatable water craft of claim 2 wherein the cover carries a cover inflation valve through which the cover is inflated separately from the body member.

9. The inflatable water craft of claim 3 wherein the cover carries a cover inflation valve through which the cover is inflated separately from the body member.

10. The inflatable water craft of claim 4 wherein the cover carries a cover inflation valve through which the cover is inflated separately from the body member.

11. The inflatable water craft of claim 5 wherein the cover carries a cover inflation valve through which the cover is inflated separately from the body member.

12. The inflatable water craft of claim 6 wherein the cover carries a cover inflation valve through which the cover is inflated separately from the body member.

* * * * *